US006471574B1

(12) United States Patent
Rupprecht et al.

(10) Patent No.: US 6,471,574 B1
(45) Date of Patent: Oct. 29, 2002

(54) DUST PROTECTION COVER FOR A ROTARY GRINDING TOOL

(75) Inventors: Hans Rupprecht, Munich; Rolf Spangenberg, Gauting; Diep Chau-Ngoc, Munich; Rudolf Reitberger, Munich; Oliver Ohlendorf, Munich, all of (DE)

(73) Assignee: Hilti Aktiengesellschaft, Schaan (LI)

( * ) Notice: Subject to any disclaimer, the term of this patent is extended or adjusted under 35 U.S.C. 154(b) by 94 days.

(21) Appl. No.: 09/630,027

(22) Filed: Jul. 31, 2000

(30) Foreign Application Priority Data

Aug. 3, 1999 (DE) ..... 199 36 555

(51) Int. Cl.[7] ..... B24D 11/00

(52) U.S. Cl. ..... 451/451; 451/45; 451/456; 451/452; 83/440

(58) Field of Search ..... 451/45, 456, 654, 451/452, 453, 451; 83/440

(56) References Cited

U.S. PATENT DOCUMENTS 448,300 A * 3/1891 Nichols ..... 451/140
1,086,745 A * 2/1914 Athy ..... 29/DIG. 78
3,882,644 A * 5/1975 Cusumano ..... 451/359
5,125,190 A * 6/1992 Buser et al. ..... 451/359

* cited by examiner

*Primary Examiner*—Timothy V. Eley
*Assistant Examiner*—Alvin J. Grant
(74) *Attorney, Agent, or Firm*—Sidley Austin Brown & Wood, LLP

(57) ABSTRACT

A dust protection cover for a rotary grinding tool and having a base (1, 11, 21) fixedly securable with the tool housing (10) a substantially circular cover body (2, 12, 22) connectable with the base (1, 11, 21) for completely circumferentially covering the grinding disc (4, 14, 24) securable at the free end of the output shaft of the tool drive motor, and displaceable between a operational position, in which the cover body completely covers the grinding disc, and a release position in which the cover body exposes a portion of a grinding disc circumference, and a connection element(s) projecting from a side of the base (1, 11, 21) adjacent to the tool housing for securing the cover body (2, 12, 22) to the base (1, 11, 21) in the release position of the cover body.

6 Claims, 4 Drawing Sheets

DUST PROTECTION COVER FOR A ROTARY GRINDING TOOL

BACKGROUND OF THE INVENTION

1. Field of the Invention

The present invention relates to a rotary grinding tool including a housing, a drive motor arranged in the housing and having an output shaft projecting from the housing and having a grinding disc secured on its free end, and relates, in particular to a dust protection cover having a base fixedly securable with the housing and a substantially circular cover body connectable with the base for completely circumferentially covering the grinding disc and displaceable between an operational position, in which the cover body completely covers the grinding disc, and a release position in which the cover body exposes at least a portion of a grinding disc circumference.

2. Description of the Prior Art

For removing material from surfaces of constructional components formed of concrete, stone, or metal, a rotary grinding tool such as disclosed, e.g., in German Utility Model DE-297 17 099 UI, is used. The rotary grinding tool disclosed in DE-297 17 099 UI includes a housing, a drive motor arranged in the housing, a grinding disc mounted on the free end of the output shaft of the drive motor, and a two-part, circular dust protection cover. The dust protection cover covers the surface of the grinding disc facing the housing and circumferentially covers the grinding disc. The first part of the dust protection cover is formed by a base fixedly connected with the housing. The second part of the dust protection cover is formed by a cover body formed as a circular segment. The cover body is pivotally supported on the base for a pivotal movement about an axle extending transverse to the longitudinal axis of the motor output shaft. A suction nipple projects from the base. The nipple is connected with an external suction device for removing grinding waste from the cover.

In order to be able to grind, with this rotary grinding tool, in corners and other locations of the constructional component, which are accessible only with much difficulties, the cover body need be lifted off the base to expose the grinding disc. The drawback of the rotary grinding tool, which is disclosed in DE-297 17 099 UI, consists in that when, after being lifted off the base and not being used for awhile, the cover can become lost or the user cannot find it.

Accordingly, an object of the present invention is to provide a dust protection cover for a rotary grinding tool of the type described above which would provide for grinding in the corners and other locations of the constructional components accessible only with much difficulties, without a need to completely lift off the cover body from the base, i.e., without a danger of the cover body being lost.

SUMMARY OF THE INVENTION

This and other objects of the present invention, which will become apparent hereinafter, are achieved by providing connection means projecting from a side of the base adjacent to the tool housing for securing the cover body to the base in the release position of the cover body.

Providing on the base connection means for securing the cover body to the base in the release position insures that the user does not need to look for the cover body after the cover body was moved to its release position. The positioning of the cover body on the base is effected rapidly and in a simple way because the connection means is arranged so that it is easily visible and accessible.

Advantageously, the connection means consists of at least one bolt extending parallel to the motor output shaft and on which the cover body is pinned up. In the preferred embodiment of the present invention, four bolts extend from the base in the direction of the housing. Two of the bolts, which are located more closely to the output shaft, have a greater length then two bolts located more remotely from the output shaft. The projection of the surface of the cover body taken parallel to the axis of the output or drive shaft has a shape of a substantially circular segment. The cover body has two clamping regions provided, respectively, at two oppositely spaced end regions. In a release position of the cover body, in which the cover body exposes a region of the circumference of the grinding disc, each clamping region is releasably mounted on a respective one of the two long bolts. The two bolts having a shorter length serve for securing the cover body with the base when the grinding disc is completely circumferentially covered by the dust protection cover.

To provide for a pivotal movement of the cover body from its operational position into its release position, when at least one bolt is used, the at least one bolt, which extends from the base toward the tool housing, forms a pivot axle and a guide for the cover body.

For displacing the cover body from its operational position into its release position, first, the cover body is displaced along the bolt toward the tool housing and then, after being lifted above the side of the base adjacent to the tool housing, is pivoted, by having its free end grasped, in a direction toward the output shaft of the drive motor, to its release position.

In order to provide for rapid and simple displacement of the cover body from its operational position to its release position, the connection means can be formed as a guide arranged substantially parallel to the diameter of the dust protection cover between the base and the cover body. The guide, e.g., can be formed of a guide channel provided, e.g., on the base, and a guide member displaceable along the guide channel and provided on the cover body. Alternatively, the guide channel can be formed in the cover body, with the guide member being provided on the base.

Advantageously, the dust protection cover is provided, at its end remote from the tool housing, with a collar projectable beyond the grinding surface of the grinding disc and formed of an elastic, air-permeable material, such as bristle. The collar forms a curtain between the free end of the dust protection cover and the surface of the constructional component to be treated.

The curtain, on one hand, prevents the grinding waste from leaving the dust protection cover and, on the other hand permits penetration of the outside air into the cover whereby interruption or breaking of the section flow generated by the external suction device is prevented.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENTS

Figure 1:
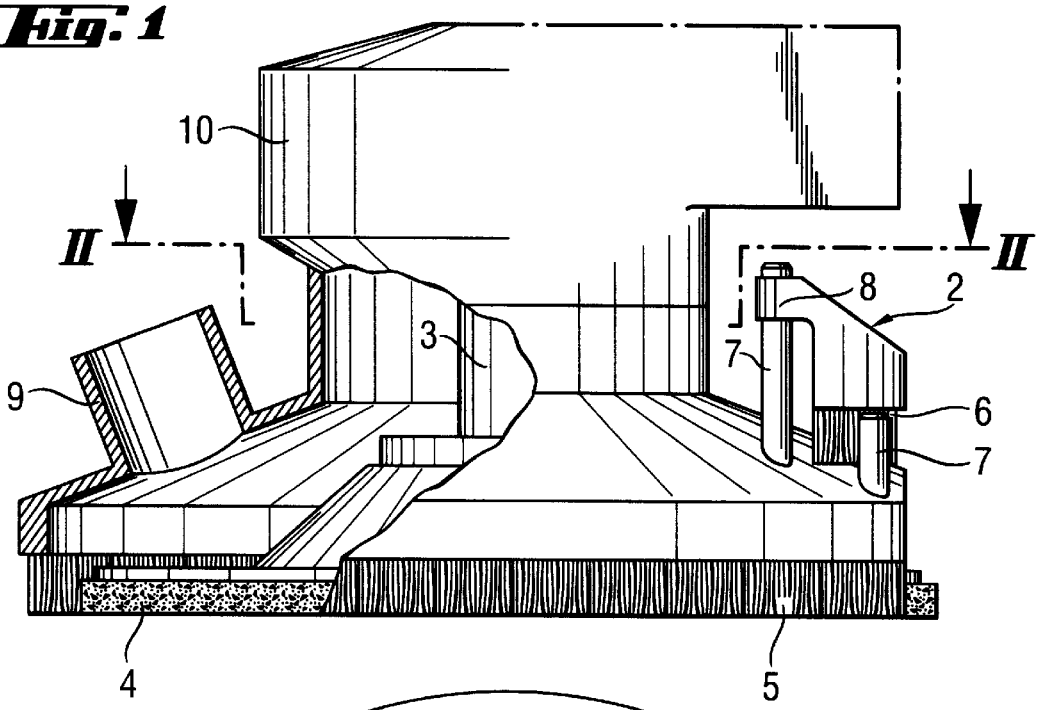
FIG. 1 a side, partially cross-sectional view of a rotary grinding tool according to the present invention, with a cover body being pinned on two bolts secured on a base.

A rotary grinding tool according to the present invention, which is shown in FIGS. 1–8, includes a housing 10 in which there is arranged an electric motor (not shown). The motor is actuated, e.g., by an electrical switch (not shown) provided on the housing 10. The electric motor has an output shaft 3, 13, 23 (FIGS. 1, 3, 5) projecting from the housing 10, with a grinding disc 4, 14, 24 being releasably secured on a free end of the shaft 3, 13, 23. The dust protection cover for the grinding disc 4, 14, 24 is formed of two parts and is designed for a complete circumferential covering of the grinding disc 4, 14, 24. The dust protection cover is formed of a base 1, 11, 21, which is fixedly connected with the housing 10, and a cover body 2, 12, 22 which is formed as a circular part and is arranged on the base 1, 11, 21.

At the free end of the dust protection cover 2, 12, 22 remote from the housing 10, there is provided a collar formed of an elastic, air-permeable material, such as bristles. The collar extends partially beyond the grinding surface of the grinding disc 4, 14, 24. A first portion 5, 15, 25 of the collar is provided on the base 1, 11, 21, and a second portion of the collar 6, 16, 26 is provided on the cover body 2, 12, 22. The case 1, 11, 21 is provided with a suction nipple 9, 19, 29 connectable with suction device (not shown).

Figure 2:
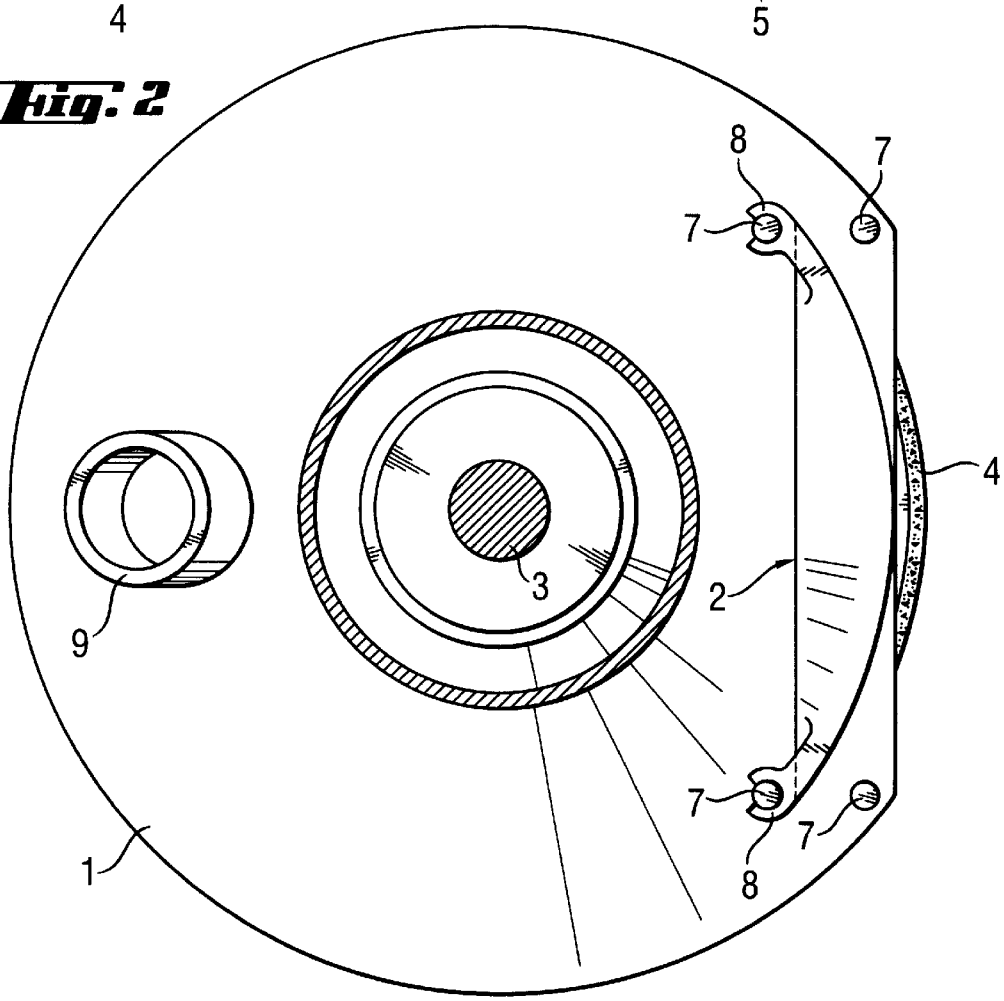
FIG. 2 a cross-sectional view along line II—II in FIG. 1.

In the embodiment shown in FIGS. 1–2, four bolts 7 extend from the base 1 in the direction of the housing 10. Two of the bolts 7, which are located more closely to the output shaft 3, have a greater length then two bolts located more remotely from the output shaft 3. The projection of the projectable surface of the cover body 2 taken parallel to the axis of the output or drive shaft 3 has a shape of a substantially circular segment. The cover body 2 has two clamping regions provided, respectively, at two oppositely spaced end regions. In a release position of the cover body 2, in which the cover body 2 exposes a region of the circumference of the grinding disc 4, each clamping region 8 is releasably mounted on a respective one of the two long bolts 7. The two bolts 7 having a shorter length serve for securing the cover body 2 with the base 1 when the grinding disc 4 is completely circumferentially covered by the dust protection cover.

Figure 3:
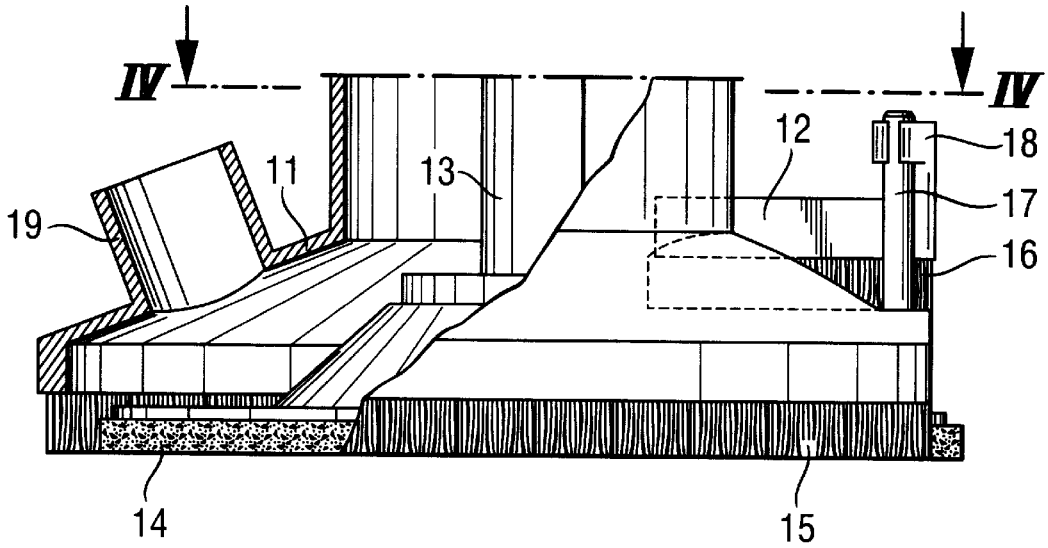
FIG. 3 a side, partially cross-sectional view of a rotary grinding tool according to the present invention, with a cover body being pivotal about a bolt secured on a base.
Figure 4:
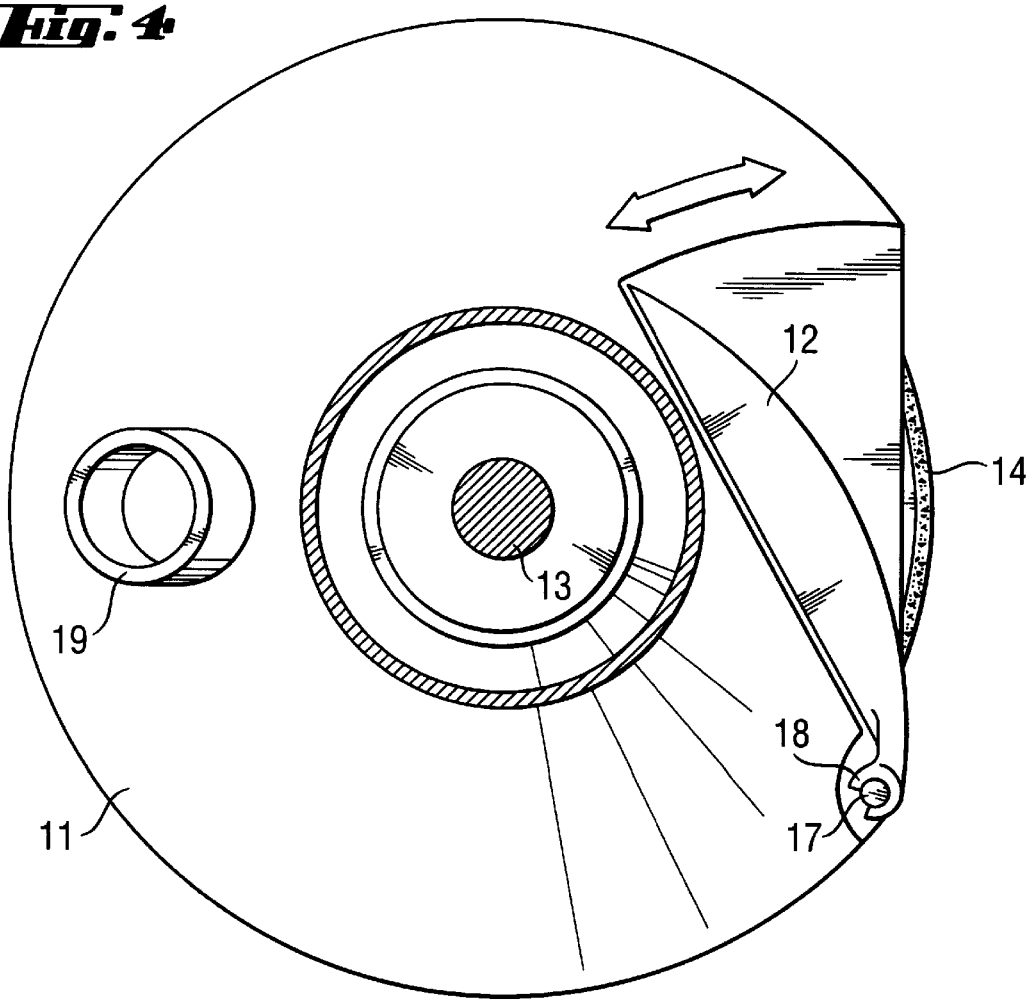
FIG. 4 a cross-sectional view along line IV—IV in FIG. 3.
Figure 5:
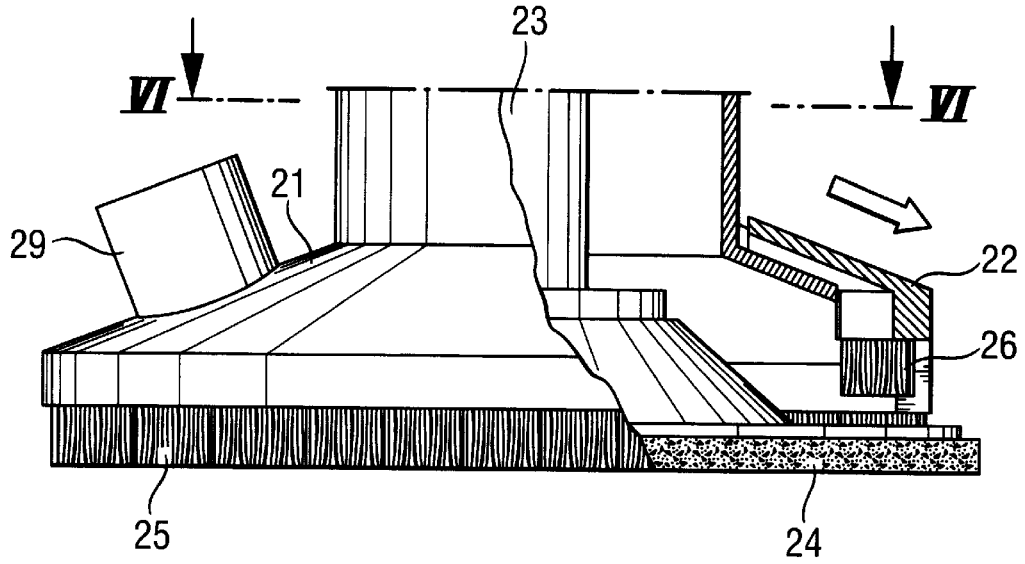
FIG. 5 a side, partially cross-sectional view of a rotary grinding tool according to the present invention, with the cover body displaceable along a guide provided on a base, being in its release position.
Figure 6:
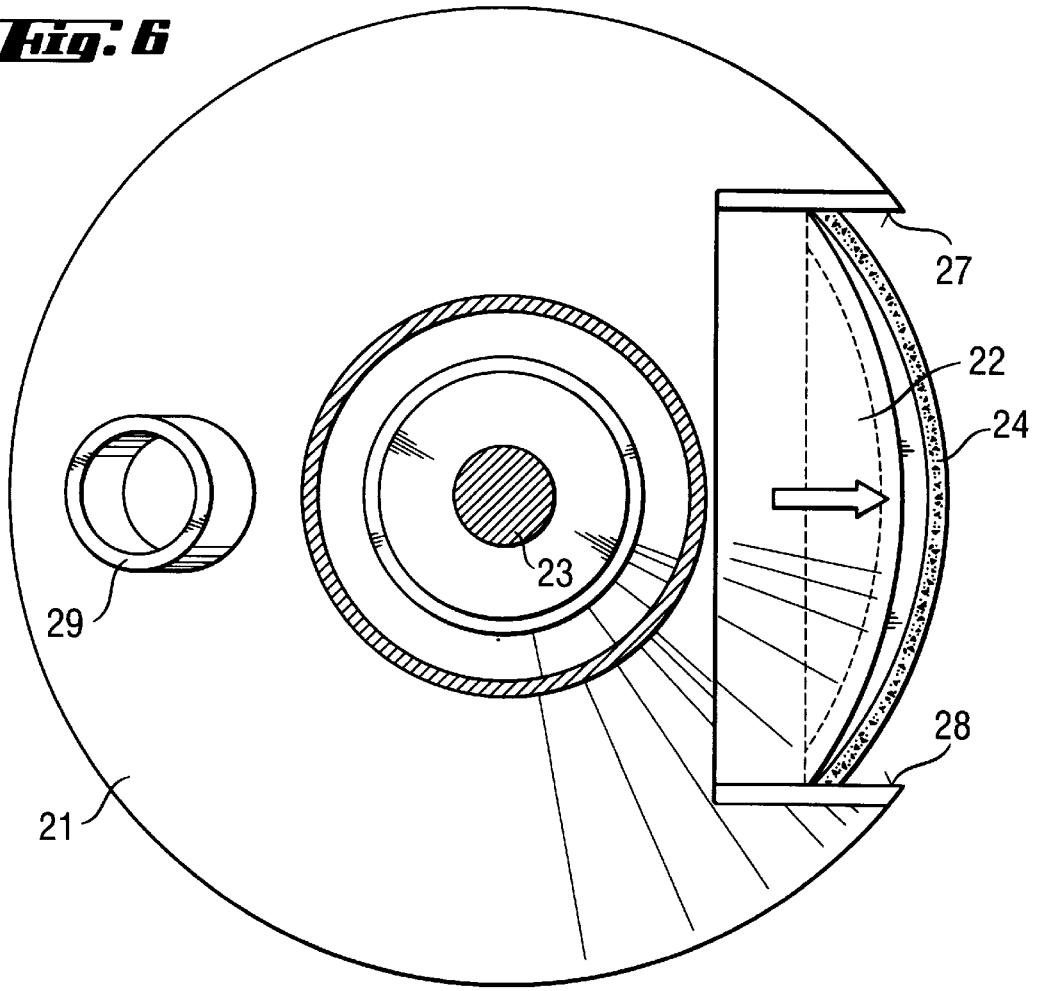
FIG. 6 a cross-sectional view along line VI—VI in FIG. 5.
Figure 7:
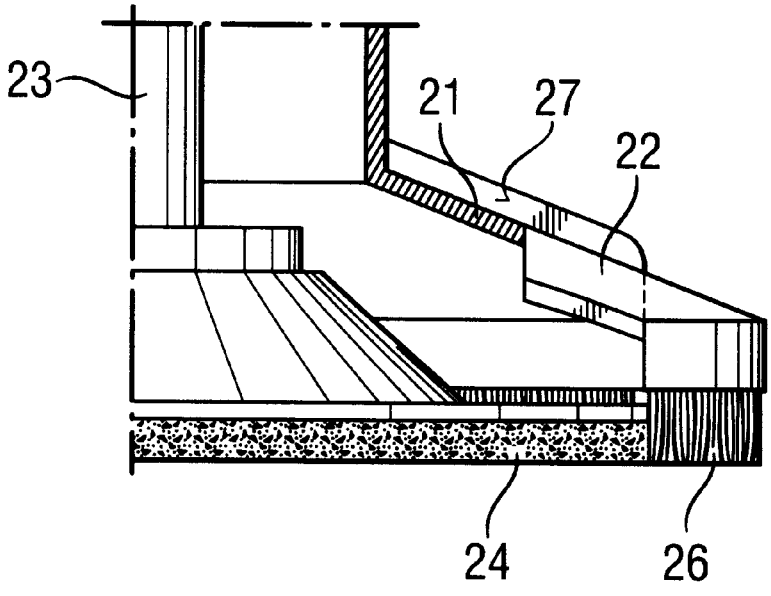
FIG. 7 a view showing a section of the tool shown in FIG. 5 with the cover body being in its operational position in which the cover body circumferentially covers the grinding disc.
Figure 8:
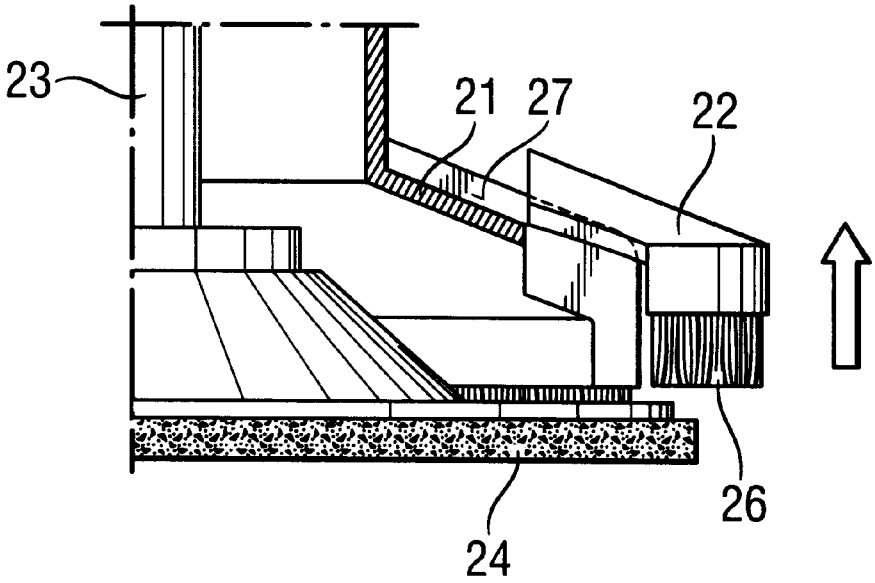
FIG. 8 a view similar to that of FIG. 7 but with the cover body being in an intermediate position between the release and operational positions of the cover body.

In the embodiment shown in FIGS. 3–4, the base 11 has only one bolt 17 provided at its circumference. The bolt 17 extends parallel to the longitudinal axis of the drive shaft 13 in a direction toward the tool housing (not shown). A cover body 12 is mounted on this bolt 7. The cover body 12 has, at its free end, a clamping region 18 which can be pinned on the bolt 17 and which at least partially surrounds the bolt 17. As in the embodiment shown in FIGS. 1–2, the projection of the cover body 12 parallel to the drive shaft axis has a shape of a substantially circular segment. The cover body 12, in the view shown in FIG. 3 which shows the cover body 2 in its release position, partially exposes a portion of the circumference of the grinding disc 14. In order to bring the cover body 12 from its release position into its operational position in which the cover body 12 completely covers the grinding disc 14, the cover body 2 is pivoted away from the drive shaft 13 and is displaced axially toward the grinding disc 14.

In the embodiment shown in FIGS. 5–8, the cover body 22 is formed as a circular sector. The cover body 22 is displaceable between its operational position, in which it completely covers the grinding disc 24, and its release position, in which it exposes a portion of the circumference of the grinding disc 24, along a guide 27, 28 arranged between the base 21 and the cover body 22. Starting from its operational position, the cover body 22 is first displaced parallel to the axis of the drive shaft 23 in a direction away from the grinding disc 24 and then in a direction substantially transversed to the drive shaft axis and into its release position. In both of its positions, the cover body 22 remains connected with the base 21 by special means (not shown). The guide 27, 28 is formed, e.g., of a guide channel (not shown) and a guide member (likewise not shown) that projects into the guide channel and is displaceable thereal-ong. The guide channel can be formed in one of the base 21 and the cover body 22, and the guide member can be provided on another of the Case 21 and the cover body 22.

Though the present invention was shown and described with references to the preferred embodiments, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. A dust protection cover for a rotary grinding tool having a housing (10), a drive motor arranged in the housing and having an output shaft (3, 13, 23) projecting from the housing (10) and having a grinding disc (4, 14, 24) secured on a free end thereof, the dust protection cover comprising a base (1, 11, 21) fixedly securable with the housing (10); a substantially circular cover body (2, 12, 22) connectable with the base (1, 11, 21) for completely circumferentially covering the grinding disc (4, 14, 24) and displaceable between an operational position, in which the cover body completely covers the grinding disc, and a release position in which the cover body exposes a portion of a grinding disc; and connection means (7, 17) projecting from a side of the base (1, 11, 21) facing in a direction of the tool housing (10) for securing the cover body (2, 12, 21) to the base (1, 12, 21) in the release position of the cover body (2, 12, 21).

2. A dust protection cover according to claim 1, wherein the connection means comprises at least one, extending substantially parallel to the output shaft (3, 13, 23), bolt (7, 17) on which the cover body is pinned up.

3. A dust protection cover according to claim 2, wherein the bolt (7, 17) forms a pivot axle for the cover body (2, 12) rotatable relative to the base (1, 11).

4. A dust protection cover according to claim 1, wherein the connection means comprises a guide (27, 28) arranged substantially parallel to a dust protection cover diameter.

5. A dust protection cover according to claim 1, comprising, at a free end thereof remote from the housing (10), a collar projectable beyond a grinding surface of the grinding disc (4, 14, 26) and formed of an elastic, air-permeable material.

6. A dust protection cover according to claim 5, wherein the collar is formed of bristles.

* * * * *